US006581772B2

(12) United States Patent
Noland

(10) Patent No.: US 6,581,772 B2
(45) Date of Patent: Jun. 24, 2003

(54) STACKABLE CONTAINER WITH TAPERED STACKING TABS

(75) Inventor: Carl M. Noland, Winter Haven, FL (US)

(73) Assignee: Packaging Corporation of America, Lake Forest, IL (US)

( * ) Notice: Subject to any disclaimer, the term of this patent is extended or adjusted under 35 U.S.C. 154(b) by 0 days.

(21) Appl. No.: 09/874,809

(22) Filed: Jun. 5, 2001

(65) Prior Publication Data

US 2002/0179481 A1 Dec. 5, 2002

(51) Int. Cl.[7] ..... B65D 21/032

(52) U.S. Cl. ..... 206/509; 229/174; 229/915; 414/802

(58) Field of Search ..... 229/174, 178, 229/915, 918, 919; 206/509, 511, 512; 414/802

(56) References Cited

U.S. PATENT DOCUMENTS

| | | | | |
|---|---|---|---|---|
| 2,893,621 A | * | 7/1959 | Harnish et al. | 229/915 |
| 3,820,706 A | | 6/1974 | Gibson et al. | |
| 3,863,831 A | | 2/1975 | Wozniacki et al. | |
| 3,871,570 A | | 3/1975 | Garmon | |
| 3,910,484 A | | 10/1975 | Wozniacki | |
| 3,910,487 A | | 10/1975 | Jaeschke | |
| 3,940,053 A | | 2/1976 | Putman et al. | |
| 4,053,098 A | | 10/1977 | Baptist | |
| 4,053,100 A | | 10/1977 | Baptist | |
| 4,082,215 A | | 4/1978 | Eichenauer | |
| 4,101,048 A | | 7/1978 | Rieben et al. | |
| 4,117,929 A | | 10/1978 | VanderMey | |
| 4,121,753 A | | 10/1978 | Westfall | |
| 4,151,948 A | | 5/1979 | de la Fuente, Jr. | |
| 4,170,297 A | | 10/1979 | Johnson | |
| 4,175,691 A | | 11/1979 | Cornell et al. | |
| 4,185,741 A | | 1/1980 | Schiff et al. | |
| 4,191,288 A | | 3/1980 | Hostad | |
| 4,228,898 A | | 10/1980 | Zeitter et al. | |
| 4,234,081 A | | 11/1980 | Champlin | |
| 4,284,195 A | | 8/1981 | Champlin | |
| 4,291,830 A | | 9/1981 | Sorensen | |
| 4,300,680 A | | 11/1981 | Champlin | |
| 4,304,351 A | | 12/1981 | Stollberg | |
| 4,324,328 A | | 4/1982 | Champlin | |
| 4,335,843 A | | 6/1982 | Kent | |
| 4,347,969 A | | 9/1982 | Kost et al. | |
| 4,349,147 A | | 9/1982 | Jensen | |
| 4,385,721 A | | 5/1983 | Olsen et al. | |
| 4,389,013 A | * | 6/1983 | Hall et al. | 206/509 |
| 4,391,405 A | | 7/1983 | Drinon | |
| 4,418,863 A | | 12/1983 | Kimbrell, Sr. | |
| 4,441,649 A | | 4/1984 | Nederveld | |
| 4,511,080 A | | 4/1985 | Madsen et al. | |
| 4,526,317 A | | 7/1985 | Cassidy | |
| 4,537,344 A | | 8/1985 | Thomas | |
| 4,567,996 A | | 2/1986 | Muise | |
| 4,570,790 A | | 2/1986 | Turnage | |
| 4,600,142 A | | 7/1986 | Quaintance | |
| 4,613,045 A | | 9/1986 | Watson | |
| 4,645,122 A | | 2/1987 | Nederveld | |

(List continued on next page.)

FOREIGN PATENT DOCUMENTS

| | | | | |
|---|---|---|---|---|
| FR | 2682936 | * | 4/1993 | 229/174 |
| FR | 2728867 A1 | | 12/1994 | |
| WO | 99/43560 | | 9/1999 | |

*Primary Examiner*—Gary E. Elkins
(74) *Attorney, Agent, or Firm*—Jenkens & Gilchrist

(57) ABSTRACT

A container has a bottom panel, side walls, and end walls, with the bottom panel having recesses for accepting stacking tabs The side walls are provided with stacking tabs which are tapered inwardly so as to align with the recesses in the bottom panel of a second container. The inwardly tapered tabs allow for easy stacking without the tabs being deformed when containers are stacked atop one another. To improve strength, the side and end walls are disposed approximately at right angles to the bottom panel. Multiple plies of material are used along the container walls to increase container strength.

25 Claims, 8 Drawing Sheets

U.S. PATENT DOCUMENTS

| | | | | | |
|---|---|---|---|---|---|
| 4,676,429 | A | | 6/1987 | Crowe et al. | |
| 4,770,339 | A | | 9/1988 | Weimer | |
| 4,787,515 | A | | 11/1988 | Stoll | |
| 4,852,756 | A | | 8/1989 | Holladay | |
| 4,883,221 | A | | 11/1989 | Brundage | |
| 4,884,739 | A | | 12/1989 | Nederveld | |
| 4,884,741 | A | | 12/1989 | Nederveld | |
| 4,946,093 | A | | 8/1990 | Moorman | |
| 4,949,898 | A | | 8/1990 | Nederveld | |
| 5,000,377 | A | | 3/1991 | McClure | |
| 5,002,224 | A | | 3/1991 | Muise | |
| 5,052,615 | A | | 10/1991 | Ott et al. | |
| 5,125,567 | A | | 6/1992 | McClure | |
| 5,139,196 | A | | 8/1992 | Fry et al. | |
| 5,163,609 | A | | 11/1992 | Muise, Jr. | |
| 5,261,594 | A | | 11/1993 | Brown et al. | |
| 5,263,612 | A | | 11/1993 | Nederveld | |
| 5,277,360 | A | | 1/1994 | DeMott | |
| 5,285,956 | A | | 2/1994 | Piepho | |
| 5,289,970 | A | | 3/1994 | McClure | |
| 5,294,044 | A | | 3/1994 | Clark | |
| 5,330,094 | A | | 7/1994 | Mertz | |
| 5,361,975 | A | | 11/1994 | Droste et al. | |
| 5,361,976 | A | | 11/1994 | Blomfield | |
| 5,370,303 | A | | 12/1994 | Fry | |
| 5,386,937 | A | | 2/1995 | Crawford | |
| 5,392,985 | A | | 2/1995 | Smith et al. | |
| 5,429,296 | A | | 7/1995 | Southwell et al. | 229/178 |
| 5,458,272 | A | | 10/1995 | Ward-Weber | |
| 5,458,283 | A | | 10/1995 | Southwell et al. | |
| 5,516,034 | A | | 5/1996 | Jensen et al. | |
| 5,535,941 | A | | 7/1996 | Garza | |
| 5,575,419 | A | * | 11/1996 | Ross et al. | 229/919 |
| 5,649,663 | A | | 7/1997 | Pestow, Jr. | 229/174 |
| 5,673,848 | A | | 10/1997 | Garza | |
| 5,687,902 | A | | 11/1997 | Tusing et al. | |
| 5,704,193 | A | | 1/1998 | Roe et al. | |
| 5,752,597 | A | | 5/1998 | Brangle, Jr. | |
| 5,860,590 | A | | 1/1999 | Blomfield et al. | 229/918 |
| 6,131,805 | A | * | 10/2000 | Gasior | 229/918 |
| 6,270,009 | B1 | * | 8/2001 | Heeren | 229/178 |
| 6,286,753 | B1 | | 9/2001 | Jackson et al. | 229/174 |
| 6,296,178 | B1 | * | 10/2001 | McKenna, Sr. | 229/174 |
| 6,302,323 | B1 | | 10/2001 | Southwell | 229/174 |
| 6,354,487 | B1 | * | 3/2002 | Muise, Jr. | 229/915 |

* cited by examiner

STACKABLE CONTAINER WITH TAPERED STACKING TABS

FIELD OF THE INVENTION

The present invention relates generally to packaging for containing, retaining, protecting and displaying produce and other products and methods for making such containers. More particularly, the present application relates to a low-cost, single-blank goods container having tapered stacking tabs.

BACKGROUND OF THE INVENTION

Flat sheets of corrugated fiberboard, typically referred to as blanks, have been used for many years as the starting material to form produce containers. Corrugated fiberboard generally refers to a multi-layer sheet material comprised of two sheets of liner bonded to a central corrugated layer of medium. Given a basic size requirement specified by the customer, industry standards, and the preference for low cost, paperboard container manufacturers strive to provide maximum structural stacking strength with a minimal amount of corrugated fiberboard. A typical well-known container is a single-piece tray design having a bottom wall, two side walls and two end walls each connected to the bottom wall.

Typical containers for the support and transport of food produce articles and other retail goods are corrugated containers having fixed configurations. These containers must be filled for transport, and later stacked on-site for display or storage purposes. During shipment, storage, and display at retail markets, it is desirable to stack these containers atop one another. Cross-stacking or unsecured columnar stacking of containers for produce and other goods results in unstable loads, with the potential of upper containers falling into lower containers, damaging product in the containers and often toppling a stack of containers.

Therefore, it is desirable to provide a package which can be easily filled and stacked in a stable unitload, with little to no chance of stacked containers above falling into containers below. It is further desirable to provide a stable stacking package which may be assembled quickly and efficiently from a single blank, also maximizing interior space, ease of stacking, stacking stability, and structural strength while holding produce or other goods. There exists a need for such a package which also is easily loaded and unloaded and which maintains its strength throughout its use during loading, shipping, displaying, and unloading.

SUMMARY OF THE INVENTION

According to one embodiment of the present invention, a container is provided which is economical to manufacture and easily stacked, while maintaining a high degree of structural and stacking stability.

In one embodiment of the present invention, a container with inwardly tapered stacking tabs is provided, with the stacking tabs being adapted to fit into tab receptacles in a bottom panel of an above-stacked container.

According to another embodiment of the present invention, a single blank for formation of a stackable container having inwardly tapered stacking tabs and downwardly opening stacking receptacles is provided.

According to yet another embodiment of the present invention, a method for forming a container results in a sturdy container having inwardly tapered stacking tabs.

The above summary of the present invention is not intended to represent each embodiment, or every aspect of the present invention. This is the purpose of the figures and detailed description which follow.

BRIEF DESCRIPTION OF THE DRAWINGS

Other objects and advantages of the invention will become apparent upon reading the following detailed description and upon reference to the drawings in which.

Figure 1:
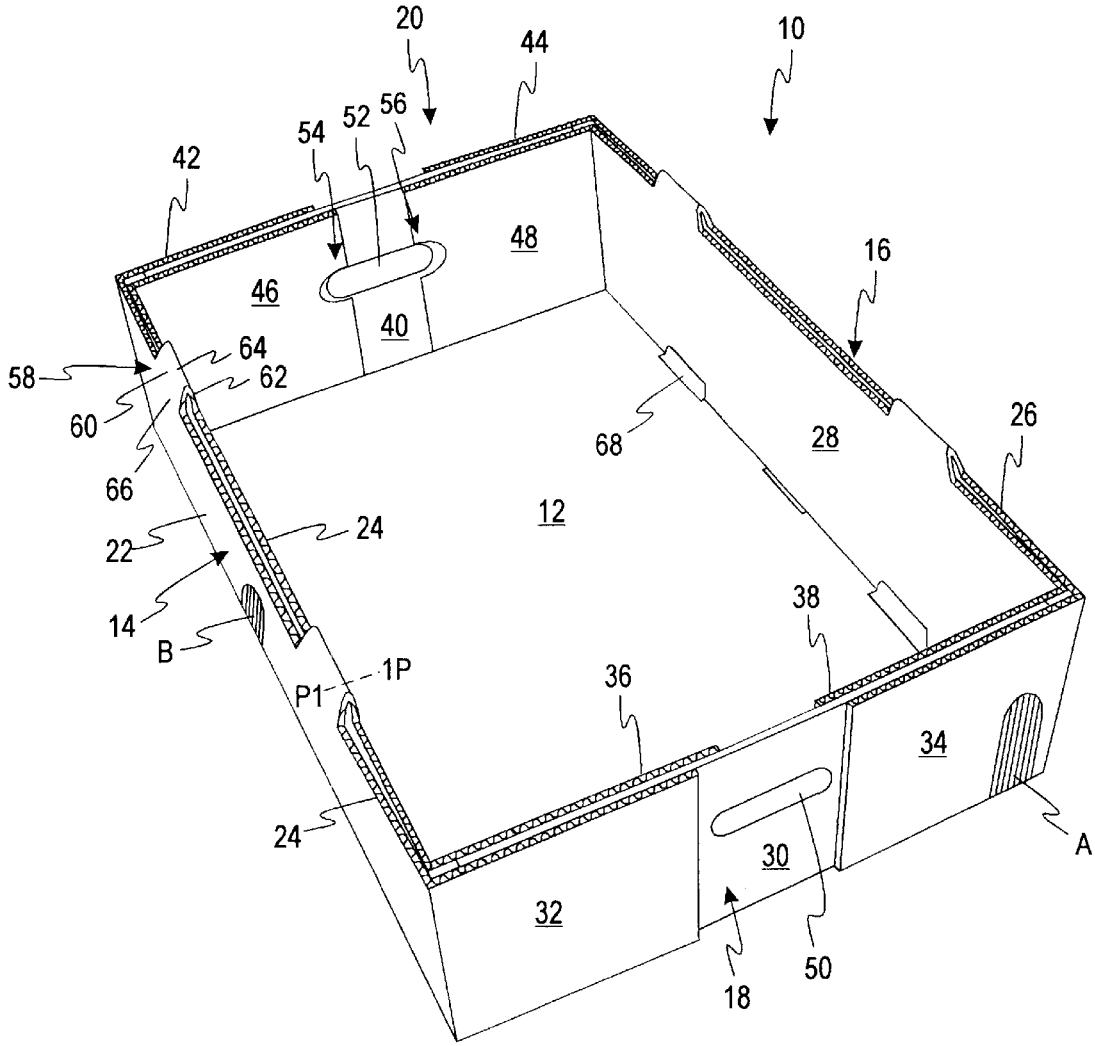
FIG. 1 is a perspective view of a stackable container embodying the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

A successful design for a container must overcome many obstacles to achieve superior performance. A container must be inexpensive and easy to assemble. At the same time, a container for produce or other goods must have tremendous structural integrity to prevent damage to goods that could occur if the container were to collapse. This structural integrity must be maintained against forces encountered when containers are stacked and transported. Further, the containers must be easy to stack atop of one another and, when stacked, the containers must retain great stacking strength and stability. A container may incorporate holes in its side walls to allow for access holes and airflow vents. In some applications, is also desirable for a container to be displayable to consumers at stores and to allow for the greatest amount of goods to be contained within the container while using a limited amount of material.

Even containers that feature acceptable stacking strength and structural integrity often encounter compromised stacking stability when the containers are jostled during shipment. It is desirable for containers to maintain a strong connection between each other while stacked atop one another.

An economical, stackable container 10, as shown in FIG. 1, is a preferred embodiment of the present invention, solving the problems described above in an easily-assembled and economical manner. The container 10 is preferably constructed of corrugated fiberboard but it will be appreciated that the container 10 could alternatively be constructed of solid fiberboard, heavy paperboard, heavy plastic sheeting, or other suitable rigid construction materials. The container 10 includes a bottom panel 12, first and second side walls 14 and 16, and first and second end walls 18 and 20, which serve to form the basic structure of the container 10.

In manufacturing a container according to the present invention, it is desirable to provide walls having great strength. One way of providing stronger walls is to include several layers of material in the walls, and this technique is used in the container 10. The first side wall 14 is formed of an outer first side wall panel 22 and an inner first side wall panel 24, and the second side wall 16 is formed of an outer second side wall panel 26 and an inner second side wall panel 28.

Likewise, the first end wall 18 and the second end wall 20 are both constructed of several layered wall panels. The first end wall 18 includes a first end wall major panel 30, and first and second outside first end wall minor panels 32 and 34. The first end wall 30 is strengthened on the inside by first and second inside first end wall minor panels 36 and 38.

Similarly to the first end wall 18, the second end wall 20 contains a major panel supported by inside and outside minor panels. The second end wall 20 includes a second end wall major panel 40 supported on the outside by first and second outside second end wall minor panels 42 and 44 and on the inside by first and second inside second end wall minor panels 46 and 48.

First and second access holes 50 and 52 are provided in the container 10 for easy handling. To allow for the access holes, the minor panels supporting the major end panels may be manufactured with cutaways allowing the minor panels to be extended past the edges of the first and second access holes 50 and 52. While FIG. 1 shows the first and second access holes 50 and 52 located in the first and second end walls 18 an 20, it is to be understood that access holes could, either alternatively or additionally, be located in the first and second side walls 14 and 16. FIG. 1 shows the first and second inside second end wall minor panels 46 and 48 having first and second minor panel cutaways 54 and 56. The perspective of FIG. 1 hides similar cutaways in the first and second inside first end wall minor panels 36 and 38. The outside end wall minor panels 32, 34, 42, and 44 of the container 10 of FIG. 1 are cut shorter than the inside end wall minor panels 36, 38, 46, and 48, so that cutaways are not necessary on the outside end wall minor panels 32, 34, 42, and 44. Alternatively, all minor panels could be cut shorter so as not to require cutaways, or all minor panels could be cut so long as to require cutaways. It may be advantageous to make all minor panels long enough to require cutaways, in order to provide stronger access holes having multiple plies of material. If desired, these panels may be extended beyond the dimensions of the blank 70 shown in FIG. 2.

The minor panels are preferably cut and folded so that the corrugation pattern in the minor panels runs vertically, as shown in the cutaway section "A." Likewise, the corrugation pattern in the inner and outer side wall panels runs vertically, as shown in the side wall cutaway section "B." While the multiple plies of material on the end and side walls contribute to the overall stability of the container 10, the vertically disposed corrugation pattern increases structural stability when several containers 10 are stacked atop one another.

Stacking stability is further enhanced by the use of stacking tabs 58, shown in FIG. 1 extending upwardly from the side walls 14 and 16. Alternatively, the construction of the container 10 could be altered so that the stacking tabs 58 extend upwardly from the end walls 18 and 20, with minor panels being disposed on side walls rather than end walls. The stacking tabs 58 are constructed with outer tab portions 60 and inner tab portions 62, with tab creases 64 running along the top of the stacking tabs 58. When the stacking tabs are situated along side walls, the stacking tabs 58 are also provided with outer tab portion score lines 66 between the outer side wall panels and the outer tab portions 60. The overall strength of the container 10, especially when stacked, is enhanced through the first and second side walls 14 and 16 and the first and second end walls 18 and 20 being disposed at right angles to the bottom panel 12.

To enable easy mating with stacking tab receptacles 68, which are located at least partially in the bottom panel 12, and alternatively in part or entirely along the inner side panels 28 and 24, the stacking tabs 58 are tapered inwardly, toward a center line of the container 10. This inwardly tapering formation may be accomplished through the use of a shorter inner tab portion 62 as compared to the outer tab portion 60. Thus, when, for example, the outer first side wall panel 22 and the inner first side wall panel 24 are folded together so that their tops align, the shorter inner tab portion 62 is pulled downwardly, and the longer outer tab portion 60 is pulled inwardly. The inward tilting of the outer tab portion 60 is facilitated through the use of the outer tab portion score line 66. In one preferred construction, the inner tab portion 62 is approximately 18 mm in length and the outer tab portion 60 is approximately 22 mm in length, resulting in an inner tab portion 62 that is approximately 80% as long as the outer tab portion 60.

Alternatively, the inward tapering of a stacking tab 58 may be accomplished through the use of shorter inner side wall panels 24 and 28, with equally long outer and inner tab portions 60 and 62. In this configuration, when the shorter inner side wall panels 24 and 28 are folded downward to meet with the bottom panel 12 (as described in more detail below), the inner tab portion 62 of a stacking tab 58 is brought downward and the outer tab portion 62 is brought inward.

A stacking tab receptacle 68 may be formed entirely in the bottom panel 12, or, as shown in FIG. 1, it may be formed from a variety of holes and recesses when the stacking tab receptacle 68 is designed to include more than the bottom wall. The stacking tab receptacles 68 of FIG. 1 are formed partially of cutouts in the bottom panel 12 and partially of cutouts in the inner first and second side wall panels, 24 and 28.

Figure 2:
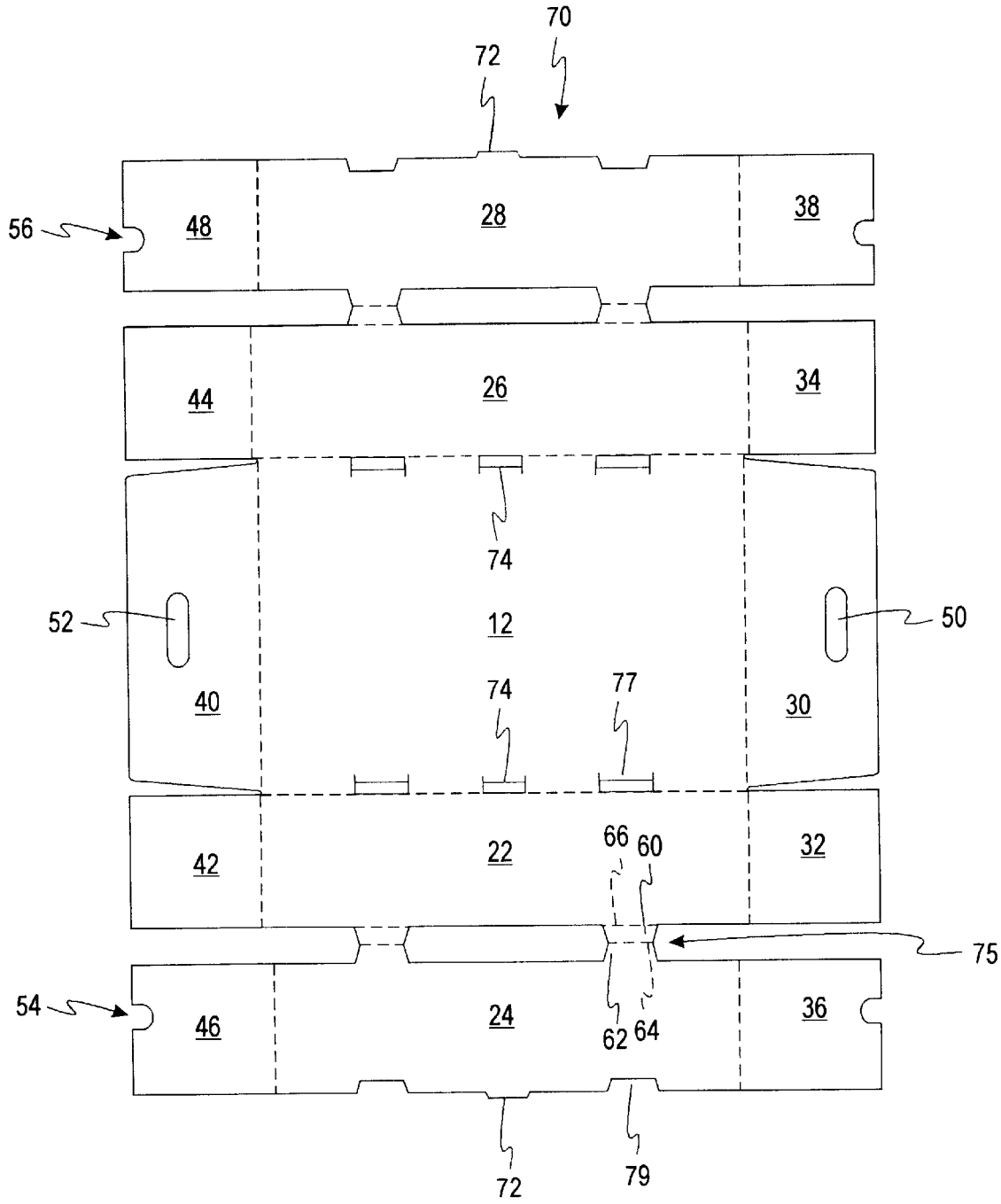
FIG. 2 is a plan view of the inner surface of a blank for forming the stackable container in FIG. 1.

Turning now to FIG. 2, a plan view for a blank 70 for use in forming the container 10 is shown. A blank 70 according to the present invention may be formed into the container 10 manually or through the use of a forming machine, and adhesive may be applied at various areas to join surfaces. A number of cuts and creases are used to allow the blank 70 to form the container 10. Cuts are shown as solid lines in FIG. 2 and creases are shown as dotted lines. Forming tabs 72 may be provided to fit into forming tab receptacles 74, improving the connection between the first and second inner side wall panels 24 and 28 and the bottom panel 12. The plan view of FIG. 2 shows how stacking tab assemblies 75 connect the outer side wall panels to the inner side wall panels before formation of the container 10. Also visible in FIG. 2 are bottom wall stacking tab receptacle cutouts 77 and inner side wall stacking tab receptacle cutouts 79 for accepting stacking tabs.

Figure 3:
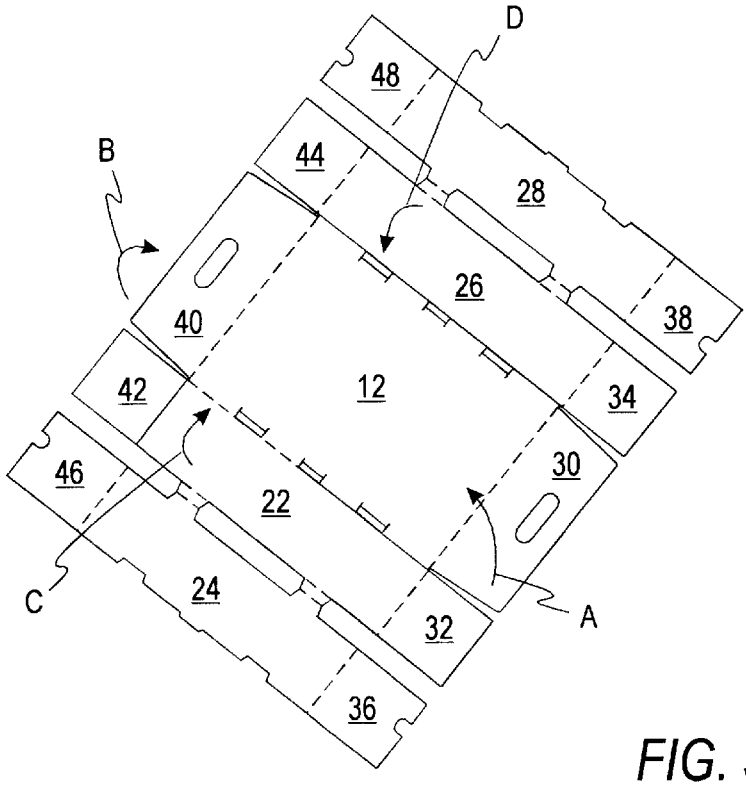
FIGS. 3 and 4 are perspective views illustrating the sequence in which the panels of the blank in FIG. 2 are folded to form the stackable container in FIG. 1.

Turning now to FIG. 3, a perspective view of a blank 70 is shown for the purpose of demonstrating how the container 10 is constructed. The first and second end wall major panels 30 and 40 are folded upwardly as shown, respectively, by arrows "A" and "B." Formation of the side walls 14 and 16 begins when the outer first and second side wall panels 22 and 26 are folded upwardly as shown, respectively, by arrows "C" and "D." As the outer first and second side wall panels 22 and 26 are folded upwardly, inner first and second side wall panels 24 and 28 and other attached panels follow upwardly, resulting in the formation shown in FIG. 4.

Figure 4:
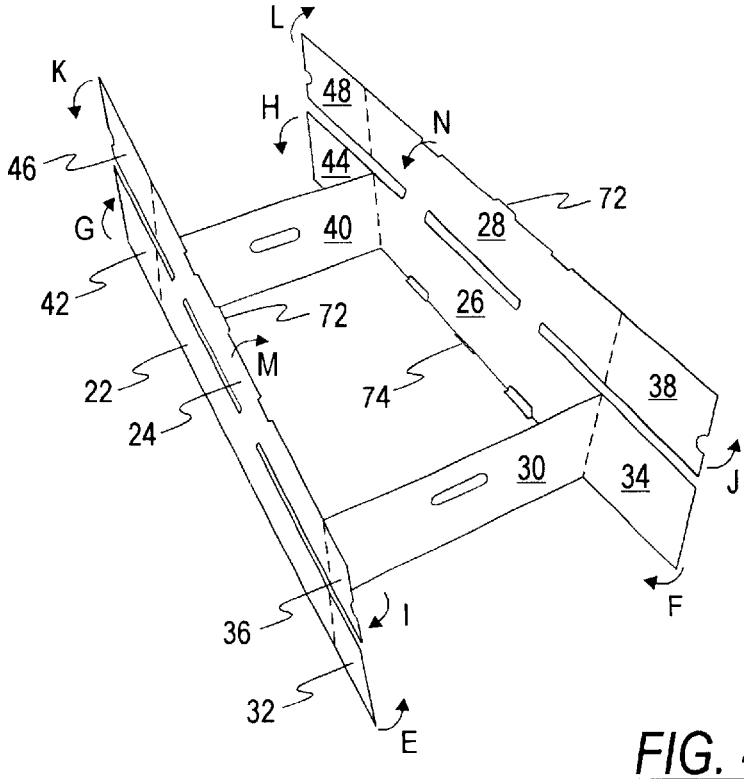

Next, as shown in FIG. 4, the first and second outside first end wall minor panels 32 and 34 are folded inwardly as shown, respectively, by arrows "E" and "F." Likewise, the first and second outside second end wall minor panels 42 and 44 are folded inwardly as shown, respectively, by arrows "G" and "H." After these folds, the outside first end wall minor panels 32 and 34 abut the first end wall major panel 30 and the outside second end wall minor panels 32 and 34 abut the second end wall major panel 40. Adhesive may be applied to the abutting surfaces of the end wall major panels 30 and 40 and the outside end wall minor panels to assure a strong connection.

As further shown in FIG. 4, the first and second inside first end wall minor panels 36 and 38 are folded outwardly as shown, respectively, by arrows "I" and "J." Likewise, the first and second inside second end wall minor panels 46 and 48 are folded outwardly as shown, respectively, by arrows "K" and "L." Next, the inner first side wall panel 24 and the inner second side wall panel 28 are folded inwardly as shown, respectively, by arrows "M" and "N." At this point, the forming tabs 72 may be inserted into the forming tab receptacles 74. Further, following the folding of the inner first and second side wall panels 24 and 28, the inside first end wall minor panels 36 and 38 abut the inner surface of the first end wall major panel 30 and the inside second end wall minor panels 46 and 48 abut the inner surface of the second end wall major panel 40. Adhesive may be provided to keep these abutting surfaces strongly connected. Following the formation steps shown in FIG. 4, the container as shown in FIG. 1 is fully constructed.

Figure 5:
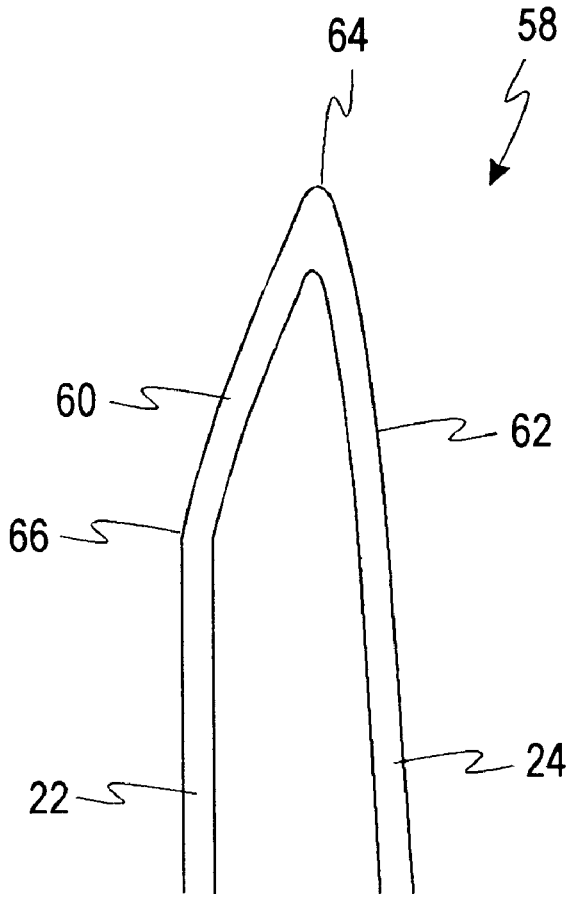
FIG. 5 is a cross-sectional view of a tapered tab according to one embodiment of the present invention.

Turning now to FIG. 5, a magnified cutaway side view of a stacking tab 58 as formed during inward folding of the inner side wall panel 24 is shown. The view of FIG. 5 is taken along the line P—P shown in FIG. 1. The stacking tab 58 is formed from the outer tab portion 60 and the inner tab portion 62. The outer tab portion 60 extends upwardly and inwardly from the outer first side wall panel 22 along the outer tab portion score line 66, and the inner tab portion 62 extends upwardly from the inner first side wall panel 24. The outer tab portion 60 and the inner tab portion 62 meet along a top tab score line 64. During formation, the inner first side wall panel 24 pulls the inner tab portion 62 downward, and the outer tab portion score line 66 allows inward bending of the outer tab portion 60 to result in the desired inwardly tapered stacking tab 58. The asymmetrical tab 58 preferably tilts inwardly to align with stacking tab receptacles 68. This arrangement reduces the chance of the stacking tabs 58 being crushed during stacking of containers 10 and further strengthens the stacking tabs 58 against lateral forces encountered during loading, stacking, shipping, and unloading. Adhesive may be applied along abutting portions of the outer first side wall panel 22 and the inner first side wall panel 24 to assure that the stacking tab 58 maintains its upright position. More score lines than shown in FIG. 5 may be used if desired, but it is to be understood that the positioning of the outer tab portion score line 66 causes the stacking tab 58 to taper inwardly.

Figure 6:
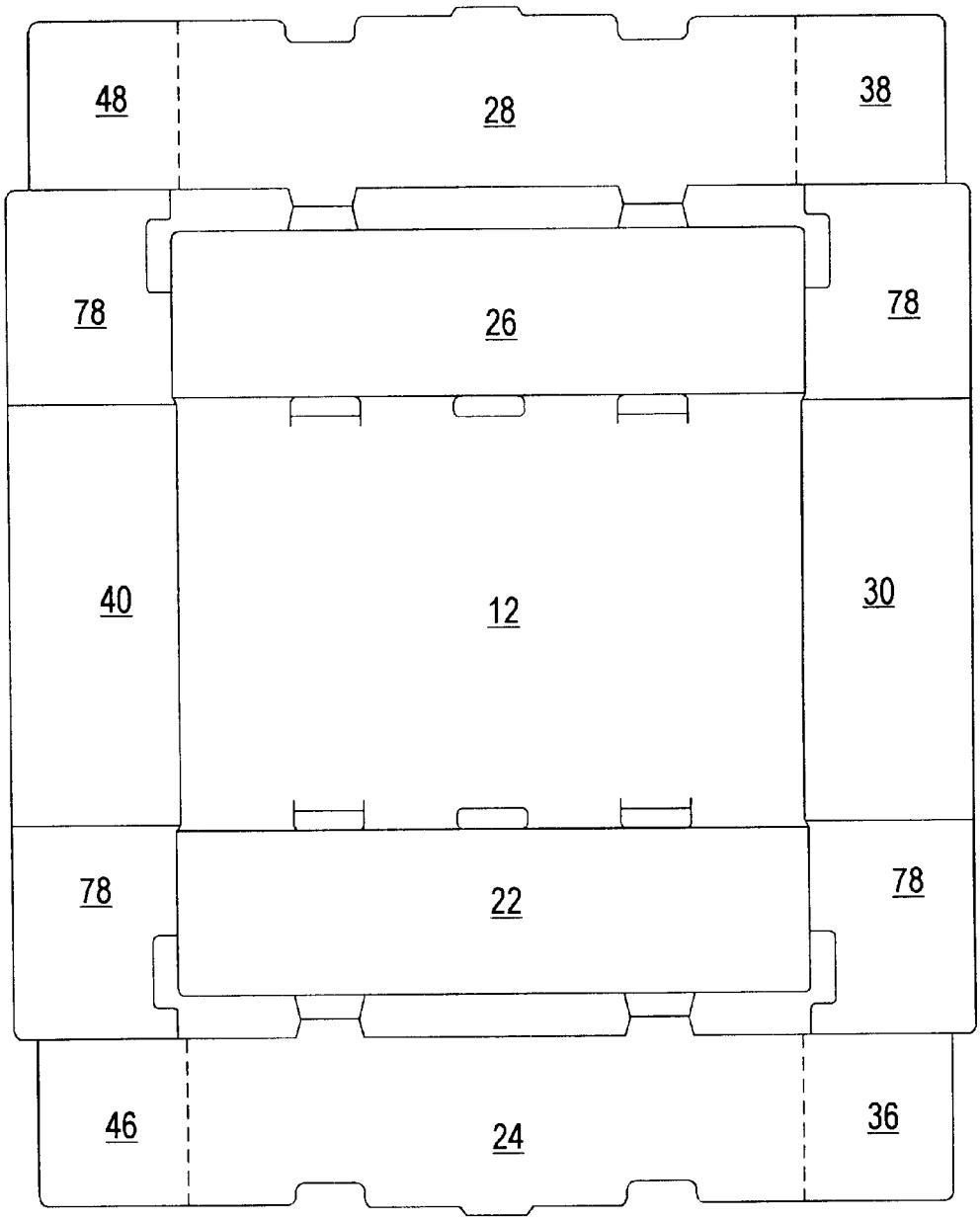
FIG. 6 is s plan view of the inner surface of an alternative blank for forming a stackable container according to an alternative embodiment of the present invention.

While the present invention has been described with reference to one or more particular embodiments, those skilled in the art will recognize that many changes may be made thereto without departing from the spirit and scope of the present invention. For example, the side walls 14 and 16 may be provided with one or more access holes or vent holes. Similarly, the end walls 18 and 20 may be provided without access holes, or with vent holes in addition to the access holes as shown. Further, minor flaps need not be situated on the blank as shown in FIG. 2. For example, FIG. 6 shows a blank 76 having outer minor side panels 78. In construction of an alternative container, the outer minor side panels 78 are folded to support the outside surfaces of the side walls. In another embodiment, only one stacking tab 58 is provided on each side wall. Further, the first and second side walls 14 and 16 may be longer than, the same size as, or shorter than the first and second end walls 18 and 20, depending on desired container characteristics.

In addition, the principles of the present invention may be applied to "half-boxes," or containers designed to be stacked such that two "half-box" containers align beneath a single container 10. "Half-box" containers may include one or more stacking tabs on end walls, side walls, or both end walls and side walls. Further, end walls may be longer, shorter, or the same length as side walls.

Figure 7:
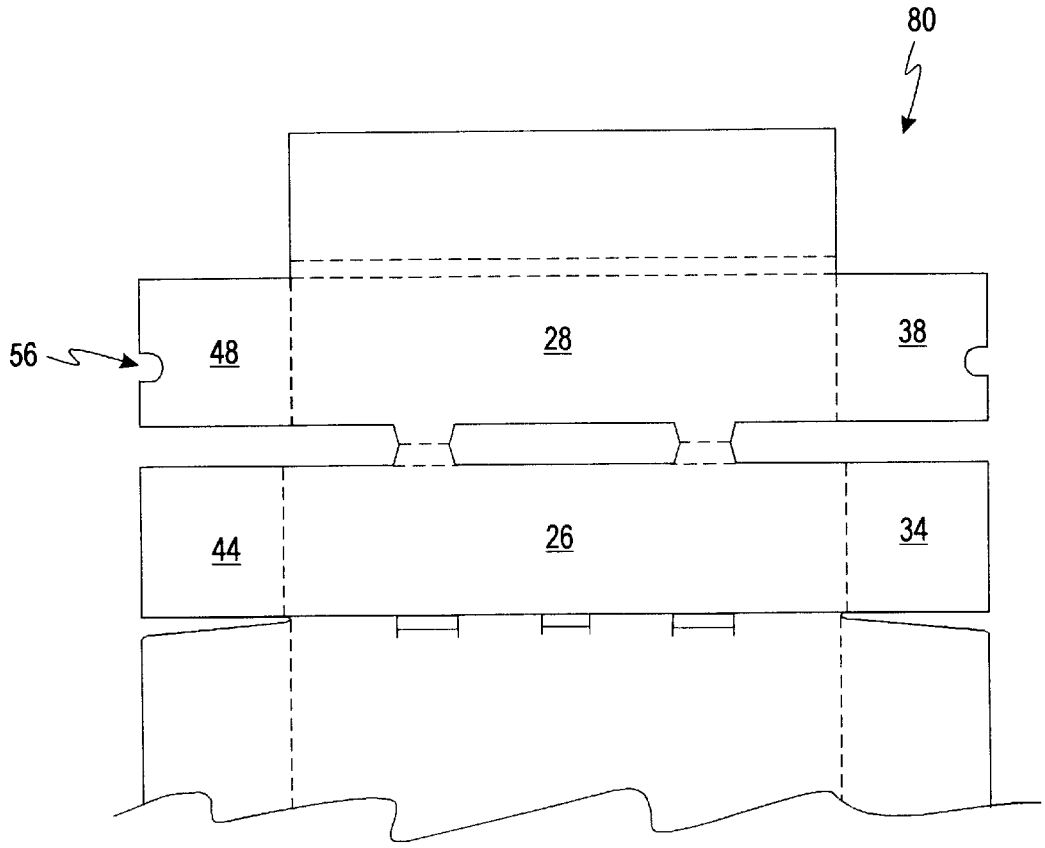
FIG. 7 is a plan view of a second alternative blank for forming a stackable container according to another alternative embodiment of the present invention.
Figure 8:
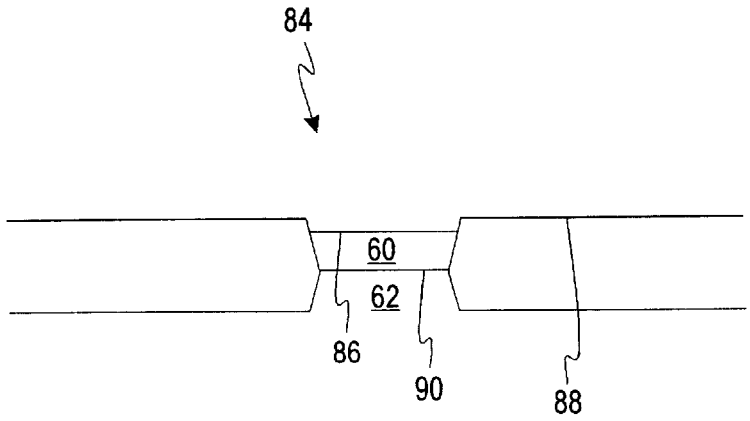
FIG. 8 is a plan view of an alternative stacking tab assembly according to one alternative embodiment of the present invention.

An alternative blank 80 having a rollover extension panel 82 extending from the inner first side wall panel 24 is shown in FIG. 7. During formation of the container 10, this rollover extension panel 82 is folded inwardly to be sandwiched between the inner and outer first side wall panels 24 and 26, further adding to the strength of the first side wall 14. It is to be understood that an equivalent structure may be used for the second side wall 16. Further, as shown in FIG. 8, a blank according to the present invention may be provided with an alternative stacking tab assembly 84 wherein a first score line 86 is provided offset from an edge 88 of an outer panel. A second score line 90 is provided along a center line of the alternative stacking tab assembly 84. When the outer 60 and inner 62 tab portions of the alternative stacking tab assembly 84 are folded toward each other, the offset first score line 86 allows the tab to taper inwardly, even tough the outer 60 and inner 62 tab portions are the same length.

Figure 9:
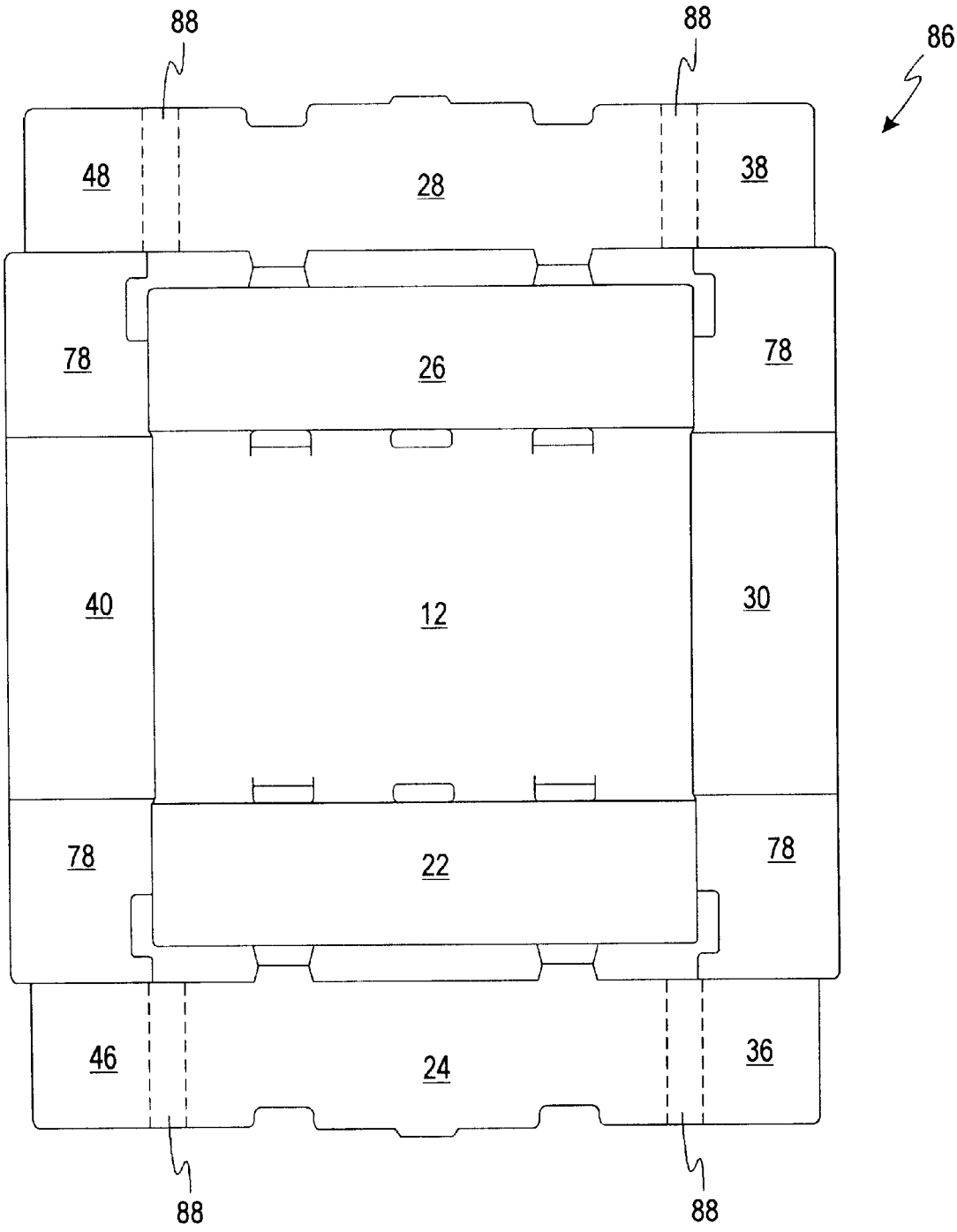
FIG. 9 is a plan view of a blank for forming a container according to another alternative embodiment of the present invention.
Figure 10:
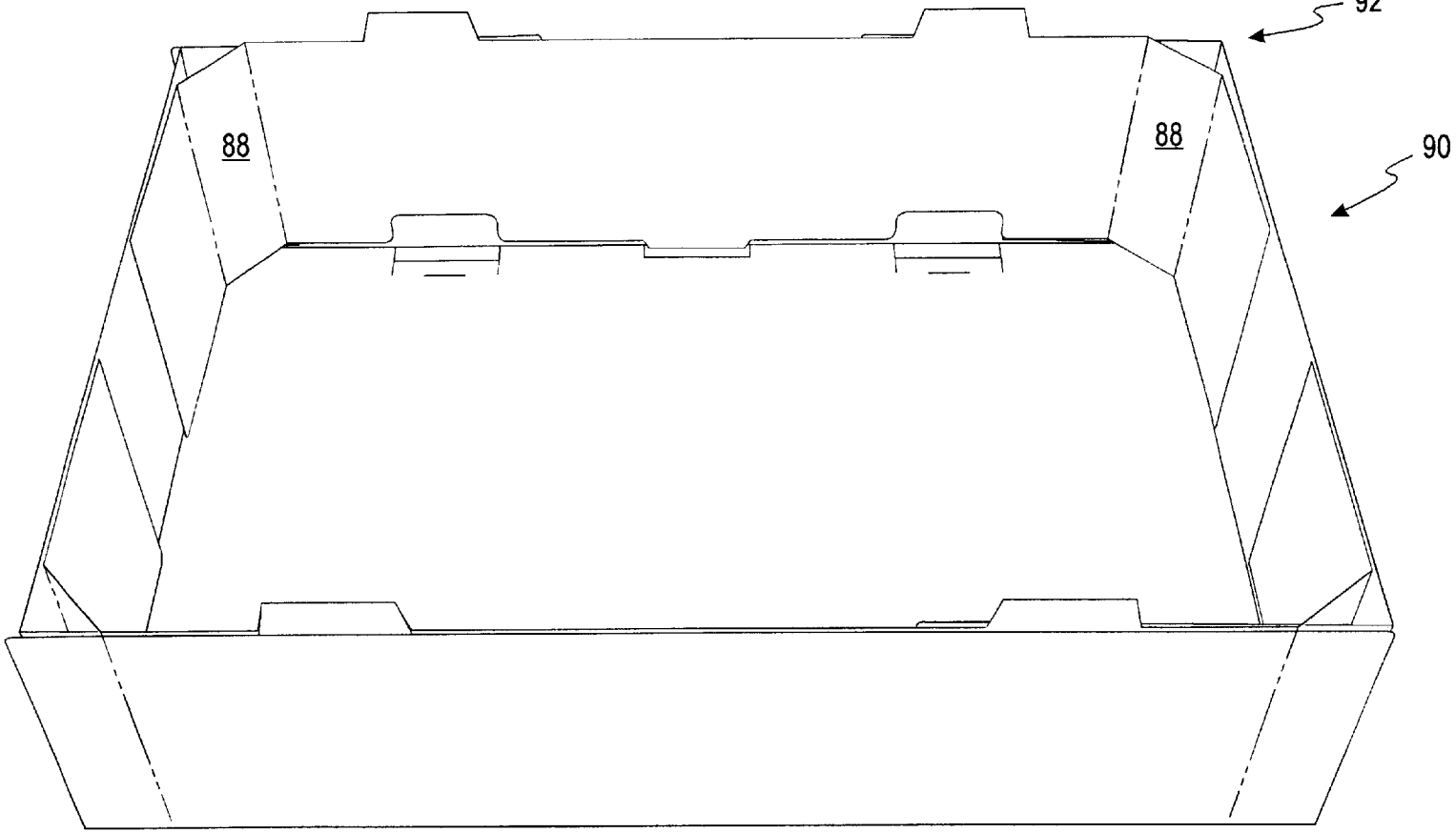
FIG. 10 is a perspective view of a container according to the present invention constructed from the blank of FIG. 9.

Further, corner structures, such as triangular or "delta" corner structures, may be provided in a container according to the present invention to enhance the anti-nesting properties of the container and improve strength in the vertical direction. FIG. 9 shows a corner structure blank 86 having corner structure panels 88 provided via score lines between the inner side wall panels 24 and 28 and the end wall minor panels 36, 38, 46, and 48. When used for forming a container, the corner structure blank results in a corner structure container 90 having corner structures 92 as shown in FIG. 10.

Each of these embodiments and obvious variations thereof is contemplated as falling within the spirit and scope of the claimed invention, which is set forth in the following claims.

What is claimed is:

1. A container comprising:

a bottom panel having at least one bottom panel stacking tab receptacle cutout; and first and second side walls, each of said first and second side walls containing at least one inwardly tapered stacking tab;

wherein said inwardly tapered stacking tabs each have outer tab portions and inner tab portions, lengths of said outer tab portions being greater than lengths of said inner tab portions.

2. The container of claim 1 wherein said lengths of said inner tab portions are from about 78% to about 82% of said lengths of said outer tab portions.

3. The container of claim 1 wherein each of said first and second side walls are provided with at least one side wall stacking tab receptacle cutout, said stacking tab receptacle cutouts aligning with said stacking tabs.

4. The container of claim 1 wherein said bottom panel has at least two stacking tab receptacles aligned with the stacking tabs.

5. The container of claim 1 wherein said inwardly tapered stacking tabs have outer tab portions having lengths of from about 10 mm to about 30 mm and inner tab portions having lengths of from about 9 mm to about 29 mm.

6. The container of claim 1 wherein said first and second side walls are disposed at an angle of about 90 degrees from said bottom panel.

7. A blank for forming a container, said blank being a single flat piece of corrugated paperboard cut and scored to provide:

a bottom panel;

two end wall major panels extending outwardly from said bottom panel;

first and second outer side wall panels extending outwardly from said bottom panel; and first and second inner side wall panels respectively extending from said first and second outer side wall panels, each of said first and second inner side wall panels attached to said first and second outer side wall panels via two stacking tab assemblies, each of said stacking tab assemblies comprising an outer tab portion having an outer tab portion length and an inner tab portion having an inner tab portion length, said inner tab portion length being shorter than said outer tab portion length.

8. The blank of claim 7, further cut and scored to provide end wall minor panels extending from said outer side wall panels and said inner side wall panels.

9. The blank of claim 7 wherein a corrugation pattern of said paperboard runs in parallel with the direction from which the end wall major panels extend from the bottom panel.

10. The blank of claim 7 further comprising eight end wall minor panels attached to respective ones of said side wall panels, at least four of said end wall minor panels including minor panel cutaways to allow for folding around the access holes.

11. A method of forming a container, comprising:

providing a blank cut and scored to have:

a bottom panel;

two end wall major panels extending outwardly from said bottom panel;

first and second outer side wall panels extending outwardly from said bottom panel; and first and second inner side wall panels respectively extending from said first and second outer side wall panels, each of said first and second inner side wall panels attached to said first and second outer side wall panels via at least one stacking tab assembly, the stacking tab assembly comprising an outer tab portion having an outer tab portion length and an inner tab portion having an inner tab portion length, said inner tab portion length being shorter than said outer tab portion length, said inner tab portion and said outer tab portion being separated by a tab crease;

folding said end wall major panels upwardly into positions approximately orthogonal to said bottom panel;

folding said outer side wall panels upwardly into positions approximately orthogonal to said bottom panel; and folding said inner side wall panels inwardly into positions approximately parallel to said outer side wall panels along said tab creases so as to form inwardly tapered stacking tabs.

12. The method of claim 11 wherein each of said inner side wall panels is further provided with at least one forming tab and said bottom panel is cut to provide at least two forming tab receptacles aligned with said forming tabs, said method further comprising inserting said forming tabs into said forming tab receptacles.

13. The method of claim 11 wherein each of said side wall panels is provided with two minor end wall panels, said method further comprising folding said minor end wall panels into contact with corresponding ones of said orthogonal end wall major panels.

14. The method of claim 13 further comprising providing adhesive between said minor end wall panels and said end wall major panels.

15. The method of claim 11 further comprising providing adhesive between said outer side wall panels and said inner side wall panels.

16. A container comprising:

a bottom panel having at least two stacking tab receptacle cutouts;

first and second side walls, each of said first and second side walls comprised of an inner side wall panel and an outer side wall panel, each of said first and second side walls having at least one inwardly tapered stacking tab extending upwardly therefrom, each of said inner side wall panels having at least one stacking tab receptacle cutout; and first and second end walls, said first end wall being supported by first and second inside first end wall minor panels and first and second outside first end wall minor panels, said second end wall being supported by first and second inside second end wall minor panels and first and second outside second end wall minor panels.

17. The container of claim 16 comprising corrugated paperboard wherein said first and second side walls are comprised of vertically corrugated fiberboard, said first and second side walls further being oriented at right angles to the bottom panel.

18. The container of claim 16 wherein said first and second side walls are further comprised of first and second rollover extension panels positioned between said inner side wall panels and said outer side wall panels.

19. A container comprising:

a bottom panel having at least two stacking tab receptacle cutouts;

first and second side walls extending at right angles upwardly from said bottom panel, each of said first and second side walls comprised of an inner side wall panel and an outer side wall panel, each of said first and second side walls having at least one inwardly tapered stacking tab extending upwardly therefrom, each of said inner side wall panels having at least one stacking tab receptacle cutout;

first and second end walls extending at right angles upwardly from said bottom panel, said first end wall being supported by first and second inside first end wall minor panels and first and second outside first end wall minor panels, said second end wall being supported by first and second inside second end wall minor panels and first and second outside second end wall minor panels; and corner structures disposed at corners formed where said side walls and said end walls meet.

20. The container of claim 19 wherein said corner structures are comprised of corner structure panels extending from said inner side wall panels to said end wall minor panels.

21. A container comprising:

a bottom panel having at least one stacking tab receptacle cutout; and first and second side walls, at least one of said first and second side walls containing at least one inwardly tapered stacking tab having an outer tab portion and an inner tab portion, a length of said outer tab portion being greater than a length of said inner tab portion.

22. The container of claim 21 wherein said length of said inner tab portion is from about 78% to about 82% of said length of said outer tap portion.

23. The container of claim 21 wherein at least one of said first and second side walls is provided with at least one side wall stacking tab receptacle cutout, said at least one side wall stacking tab receptacle cutout aligning with said at least one stacking tab.

24. The container of claim 21 wherein said inwardly tapered stacking tabs have outer tab portions having lengths of from about 10 mm about 30 mm and inner tab portions have lengths of from about 9 mm to about 29 mm.

25. The container of claim 21 wherein said first and second side walls are disposed at an angle of about 90 degrees from said bottom panel.

* * * * *